US010782065B2

(12) United States Patent
Pfister et al.

(10) Patent No.: US 10,782,065 B2
(45) Date of Patent: Sep. 22, 2020

(54) DOMESTIC APPLIANCE DEVICE

(71) Applicant: BSH HAUSGERAETE GMBH, Munich (DE)

(72) Inventors: Bernd Pfister, Ulm (DE); Andrea Fink, Gerstetten (DE); Juergen Fink, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/777,420

(22) PCT Filed: Jan. 23, 2017

(86) PCT No.: PCT/EP2017/051304
§ 371 (c)(1),
(2) Date: May 18, 2018

(87) PCT Pub. No.: WO2017/137239
PCT Pub. Date: Aug. 17, 2017

(65) Prior Publication Data

US 2018/0372399 A1 Dec. 27, 2018

(30) Foreign Application Priority Data

Feb. 12, 2016 (DE) ..... 10 2016 202 186

(51) Int. Cl.
*F25D 25/02* (2006.01)
*A47B 96/04* (2006.01)
*F25D 23/06* (2006.01)

(52) U.S. Cl.
CPC ..... *F25D 25/024* (2013.01); *F25D 23/067* (2013.01); *F25D 2325/022* (2013.01)

(58) Field of Classification Search
CPC ..... F25D 25/024; F25D 23/067; F25D 25/02; F25D 23/04
See application file for complete search history.

(56) References Cited

U.S. PATENT DOCUMENTS 3,212,836 A 10/1965 Johnson
3,234,897 A 2/1966 Berk
4,779,939 A * 10/1988 Stich ..... F25D 23/04 248/311.2
5,403,083 A 4/1995 Dasher et al.
(Continued)

FOREIGN PATENT DOCUMENTS

AU 2014271328 A1 6/2015
CN 1098780 A 2/1995
(Continued)

*Primary Examiner* — Kimberley S Wright
(74) *Attorney, Agent, or Firm* — Laurence A. Greenberg; Werner H. Stemer; Ralph E. Locher

(57) ABSTRACT

A domestic appliance device, particularly a domestic refrigerator device, has at least one appliance body with at least one a rear wall, at least one shelf unit, and at least one retainer unit provided for retaining the shelf unit. In order to improve properties with respect to advantageous shelf unit retention, the retainer unit has at least one retainer element whose main extension direction extends, in at least one operating state, at least substantially parallel to the rear wall and at least substantially in a horizontal direction.

16 Claims, 3 Drawing Sheets

(56) References Cited

U.S. PATENT DOCUMENTS

| | | | | |
|---|---|---|---|---|
| 5,549,379 | A * | 8/1996 | Jun | A47B 46/00 211/94.01 |
| 5,738,880 | A | 4/1998 | Kane et al. | |
| 7,300,120 | B2 * | 11/2007 | Shin | F25D 23/04 108/108 |
| 9,250,010 | B2 * | 2/2016 | De La Garza | F25D 25/024 |
| 9,389,012 | B2 * | 7/2016 | Rackley | F25D 23/04 |
| 9,784,494 | B2 * | 10/2017 | Chow | F25D 23/04 |
| 9,874,393 | B2 * | 1/2018 | Rackley | F25D 23/04 |
| 2003/0020387 | A1 | 1/2003 | Wing et al. | |
| 2005/0067930 | A1 * | 3/2005 | Shin | F25D 23/04 312/408 |
| 2014/0265807 | A1 * | 9/2014 | Kendall | F25D 25/021 312/408 |
| 2014/0265808 | A1 * | 9/2014 | Kendall | F25D 27/00 312/408 |
| 2014/0300266 | A1 * | 10/2014 | Rindlisbach | F25D 25/027 312/408 |
| 2014/0360220 | A1 * | 12/2014 | Rackley | F25D 23/04 62/377 |
| 2016/0123655 | A1 * | 5/2016 | Chow | F25D 23/04 312/404 |

FOREIGN PATENT DOCUMENTS

| | | | |
|---|---|---|---|
| CN | 2389564 | Y | 8/2000 |
| CN | 201032964 | Y | 3/2008 |
| DE | 29814243 | U1 | 12/1998 |
| DE | 69328470 | T2 | 9/2000 |
| DE | 202006006612 | U1 | 10/2006 |
| EP | 2881686 | A1 | 6/2015 |
| GB | 2313040 | A | 11/1997 |
| JP | 2004033537 | A | 2/2004 |

* cited by examiner

DOMESTIC APPLIANCE DEVICE

BACKGROUND OF THE INVENTION

Field of the Invention

The invention relates to a domestic appliance device, in particular a domestic refrigeration appliance device, in particular a domestic refrigeration appliance device, with at least one appliance carcass having at least one rear wall, with at least one storage unit and with at least one holding unit, which is provided to hold the storage unit.

Refrigerators with holding devices for shelves, in particular vertical holding rails arranged in a rear region of an appliance carcass, allowing shelves to be suspended, are already known from the prior art.

SUMMARY OF THE INVENTION

It is the object of the invention in particular to provide a generic device with improved properties in respect of advantageous support for storage units. According to the invention the object is achieved by the characterizing features as claimed. Advantageous configurations and developments of the invention will emerge from the dependent claims.

The invention is based on a domestic appliance device, in particular a domestic refrigeration appliance device, with at least one appliance carcass having at least one rear wall, with at least one storage unit and with at least one holding unit, which is provided to hold the storage unit.

It is proposed that the holding unit has at least one holding element, the main extension direction of which runs at least substantially parallel to the rear wall and at least substantially in a horizontal direction in at least one operating state.

"Provided" means in particular specifically designed and/or equipped. That an object is provided for a specific function means in particular that said object performs and/or executes said specific function in at least one application and/or operating state. A "domestic appliance device" in this context refers in particular to at least one part, in particular a subassembly, of a domestic appliance, in particular of a domestic refrigeration appliance. The domestic appliance device can in particular also cover the entire domestic appliance, in particular the entire domestic refrigeration appliance. The domestic appliance is particularly preferably configured as a refrigeration and/or freezer appliance, in particular a refrigerator, chiller cabinet, freezer cabinet, chest freezer, combined refrigerator/freezer and/or wine storage cabinet. In particular the appliance carcass delimits and/or defines an inner chamber, preferably at least one useful space, and comprises in particular the rear wall as well as an access opening in particular opposite the rear wall. A door of the domestic appliance device arranged on a front face of the appliance carcass is in particular configured separately from the appliance carcass. A "storage unit" refers in particular to a unit which is provided to hold objects, in particular food, standing or lying thereon. In particular the storage unit can be configured at least substantially in the manner of a plate and/or have at least one element configured at least substantially in the manner of a plate. An object "in the manner of a plate" refers here in particular to an object that has a significantly greater extension along a first spatial direction and along a second spatial direction than along a third spatial direction, preferably an extension that is greater by at least factor 5, advantageously by at least factor 10 and particularly advantageously by at least factor 20, pairs of the three spatial directions being perpendicular to one another. An "extension along a direction" of an object refers here in particular to a maximum distance between two points of a perpendicular projection of the object onto a plane parallel to the direction.

A "main extension direction" of an object refers here in particular to a direction running parallel to a longest edge of a smallest notional square that still completely encloses the object. "At least substantially parallel" here refers in particular to an alignment of a direction relative to a reference direction, in particular in a plane, the direction deviating from the reference direction in particular by less than 8°, advantageously less than 5° and particularly advantageously less than 2°. "At least substantially in a horizontal direction" here refers in particular to an alignment relative to a surface normal of a substrate, in particular a ground surface, in particular in at least one normal operating state of the domestic appliance device, the direction deviating from a direction perpendicular to the surface normal of the substrate in particular by less than 8°, advantageously less than 5° and particularly advantageously less than 2°. The holding unit preferably has at least one vertical rail element. The holding element is advantageously connected to the rail element, particularly preferably by a latching connection.

The inventive configuration in particular allows advantageous support for storage units. It is also possible to achieve a high level of flexibility, in particular in respect of an arrangement of storage units. In particular a high degree of variability of appliance use can be achieved. A useful space can advantageously be easily tailored to an operator's needs. In particular user-friendly operation can also be achieved. A holding system for differently configured storage units in particular can advantageously be achieved. Storage units can also be advantageously arranged in an appliance carcass with predominantly flat inner walls, in particular making the walls easy to clean. It is also advantageously possible to achieve a modern attractive design.

In a further configuration of the invention it is proposed that the holding element has at least one holding recess, into which at least part of the storage unit can be inserted. The holding element here can in particular have an at least substantially constant cross section. An "at least substantially constant cross section" of an object means in particular that for any first cross section of the object along at least one direction and any second cross section of the object along the direction, a minimum surface content of a differential surface formed by superimposing the cross sections is maximum 20%, advantageously maximum 10% and particularly advantageously 5% of the surface content of the greater of the two cross sections. In particular the holding element can be an element that can be produced by extrusion. The holding element is advantageously a continuously cast profile. It is however also possible for the holding element to be an element that can be produced from metal sheet. The holding element advantageously extends over at least a majority of the width of the inner chamber of the appliance carcass. "At least a majority" means in particular at least 55%, advantageously at least 65%, preferably at least 75%, particularly preferably at least 85% and particularly advantageously at least 95%. The part of the storage unit that can be inserted into the holding recess can have a width that corresponds at least substantially to an extension of the holding element along a main extension direction of the holding element. In particular a difference between the width of the part of the storage unit that can be inserted into the holding recess and the extension of the holding element along the main extension direction of the holding element is maximum 20%, preferably maximum 15%, particularly preferably maximum 10% and advantageously maximum 5% of the extension of the holding element along the main extension direction of the holding element. In the case of horizontally displaceable storage units it is however also possible for the part of the storage unit that can be inserted into the holding recess to have a width that is shorter than the extension of the holding element along the main extension direction of the holding element. "At least substantially" means in particular at least 75%, preferably at least 85% and particularly preferably at least 95%. The storage unit preferably has a hook profile element, which is connected with a form fit to at least part of the holding element in an assembled state. That at least part of the base element "can be inserted" into the holding recess means in particular that at least part of the storage unit is connected with a form fit to at least part of the holding element in an inserted state. At least part of the storage unit can advantageously be inserted into the holding recess without tools. At least part of the storage unit can particularly advantageously be inserted into the holding recess by at least one linear movement and/or at least one tilting movement of the storage unit relative to the holding unit. This advantageously allows the storage unit to be held securely. In particular the storage unit can advantageously be fitted and/or removed easily.

A main extension direction of the holding recess advantageously runs at least substantially parallel to the main extension direction of the holding element. The holding recess advantageously has a pocket, into which at least one continuation of the storage unit can be inserted with a form fit. The pocket particularly advantageously has an at least substantially constant cross section. The pocket preferably extends over at least a majority of the extension of the holding element in the direction of the main extension direction of the holding element. This advantageously makes the holding element easy to manufacture. It also allows a clear view into the inner chamber of the domestic appliance.

It is further proposed that the domestic appliance device has at least one facing element, which is arranged at least partially on a side of the holding unit facing away from the rear wall. In particular at least 70%, advantageously at least 80%, particularly advantageously at least 90% and particularly preferably at least 95% of all the points of the facing element on a respective straight line perpendicular to the rear wall through the corresponding point are located further from the rear wall than the point of the holding unit on the respective straight line furthest from the rear wall. The facing element is preferably connected to the holding unit. The facing element is advantageously connected as a single piece to the holding unit. "As a single piece" means in particular connected at least with a material fit, for example by means of a welding process, a bonding process, a spraying process and/or another process that appears expedient to the person skilled in the part, and/or advantageously molded in one piece, for example by being produced from one casting and/or by being produced in a single or multiple component injection procedure and advantageously from a single blank. In particular in an assembled state the facing element forms a rear wall element arranged in front of the rear wall of the appliance carcass. The facing element advantageously has a height and width which correspond at least substantially to a height and width of the rear wall of the appliance carcass. This advantageously makes the inner chamber easy to clean. It can also advantageously prevent damage to and/or soiling of the holding unit.

The holding element is advantageously arranged at least partially on a side of the facing element facing away from the rear wall. In particular at least 70%, advantageously at least 80%, particularly advantageously at least 90% and particularly preferably at least 95% of all the points of the holding element on a respective straight line perpendicular to the rear wall through the corresponding point are located further from the rear wall than the point of the facing element on the respective straight line furthest from the rear wall. The holding unit advantageously has two fastening elements, which hold the holding element on two opposing sides, in particular at a distance that corresponds at least substantially to a length of the holding element along a main extension direction of the holding element. "At least substantially" here means in particular that a deviation from a predefined value is in particular less than 15%, preferably less than 10% and particularly preferably less than 5% of the predefined value. The two fastening elements particularly advantageously project past the facing element in the direction of the side of the facing element facing away from the rear wall on one side of the facing element respectively and hold the holding element on the side of the facing element facing away from the rear wall. The facing element is preferably configured as a rectangular plate. The facing element particularly preferably conceals the holding unit at least partially in the direction of a side of the holding unit facing away from the rear wall. In particular the facing element conceals all parts of the holding element apart from the holding elements and the fastening element in the direction of the side of the holding unit facing away from the rear wall. This advantageously prevents soiling of the holding unit. It also advantageously allows the use of a facing element that is economical and easy to produce.

In an alternative configuration of the invention it is proposed that the facing element has at least one recess, which in at least one incorporated state at least partially exposes a holding element arranged on a side of the facing element facing the rear wall in the direction of a side of the facing element facing away from the rear wall. The recess preferably has an at least substantially rectangular cross section. A main extension direction of the recess particularly preferably runs at least substantially in a horizontal direction. The recess advantageously has a height that allows full passage of the storage unit through the recess, in particular during assembly and/or disassembly of the storage unit on/from the holding unit. It is however also possible in particular for the recess to have a height that corresponds at least substantially to a height of the storage unit when the storage unit is in a position in which said storage unit passes through the recess in an assembled state. The facing element is advantageously configured as a plate with at least substantially parallel, in particular slit-like recesses. The facing element can in particular be made of plastic and/or a suitable metal. A length of the recess in the direction of a main extension direction of the recess particularly advantageously corresponds at least substantially to a length of the holding element in the direction of a main extension direction of the holding element. A number of recesses of the facing element advantageously corresponds to a number of holding elements of the holding unit. This advantageously allows a clear view into an inner chamber. It also allows storage units to be assembled easily.

In one advantageous configuration of the invention it is proposed that the holding unit is provided to support the storage unit in such a manner that it can be displaced in at least one direction, which is aligned at least substantially parallel to the main extension direction of the holding element. That an object supports a second object "in such a manner that it can be displaced in one direction" means in particular that the object can be moved relative to the second object in at least one normal operating state, in particular subject to the action of forces as can be applied by the average human without significant effort, for example using a hand and/or arm and/or one or more fingers. In particular during displacement a position of the object relative to the second object remains at least substantially unchanged when viewed parallel to the direction, while a position of the object relative to the second object changes when viewed perpendicular to the direction. "At least substantially unchanged" here means in particular that the position of the object relative to the second object changes by less than 10 mm, advantageously by less than 5 mm, particularly advantageously by less than 1 mm. In particular the storage unit is supported in such a manner that it can be displaced in a loaded state and in an unloaded state. This allows a high level of flexibility to be achieved in respect of storage unit arrangement. In particular a domestic appliance device can be tailed to an arrangement and/or size of standing and/or lying objects, for example food. User-friendly operation is also possible.

It is further proposed that the storage unit has at least one bracing element, which counteracts a torque that results when the storage unit is held. The bracing element is advantageously connected as a single piece to the storage unit. In particular the bracing element is provided to dissipate at least a majority of the forces resulting during holding into the holding profile. The bracing element preferably has an extension along a direction parallel to a surface normal of the rear wall that corresponds to maximum 30%, advantageously maximum 20%, particularly advantageously maximum 15%, preferably maximum 10% and particularly preferably maximum 5% of an extension of the storage unit along this direction. In particular the bracing element has an at least substantially constant cross section along a main extension direction of the bracing element. The bracing element advantageously extends over at least a majority of the length of the holding element. The main extension direction of the bracing element particularly advantageously runs at least substantially parallel to the main extension direction of the holding profile in at least one assembled state. This in particular allows advantageous statics to be achieved. Also the storage unit can advantageously be held in a secure manner.

In one preferred configuration of the invention it is proposed that the storage unit is provided for toolless assembly and/or disassembly on/from the holding unit. In particular the storage unit is configured in such a manner that it can be assembled and/or disassembled by a linear movement and/or a tilting movement of the storage unit relative to the holding unit. This advantageously allows easy height adjustment of the storage unit. It also allows an arrangement of storage units to be adjusted in a user-friendly manner.

The storage unit advantageously has at least one shelf. A "shelf" here refers to a plate-like element that is provided for the storage of objects standing or lying thereon, in particular food. This advantageously allows secure positioning of objects, in particular food, on the storage unit. In particular it means that the storage unit is advantageously easy to clean.

The shelf is configured to be at least partially transparent and frameless and/or at least partially translucent and frameless. At least partially "transparent" here means in particular at least partially transparent for visible light, in particular a transparency of at least 5%, preferably at least 10%, particularly preferably at least 20%, advantageously at least 50% and particularly advantageously at least 80%, transmitted light being at least substantially parallel to incident light. At least partially "translucent" here means in particular at least partially translucent for visible light, in particular a permeability of at least 5%, preferably at least 10%, particularly preferably at least 20%, advantageously at least 50% and particularly advantageously at least 80% for an incident light, exiting light being diffused at least substantially at an angle different from 0 to the incident light. "Frameless" here means in particular that the shelf is made of the same material to its edges as at its edges. In particular the shelf has the same cross section to its edges as at its edges. In particular the shelf is made at least partially of glass, advantageously at least partially of safety glass. In particular the shelf can be made at least partially of at least partially opaque glass, in particular frosted glass. The shelf is advantageously configured as a frameless glass plate. It is however also possible for the shelf to be made of plastic. This advantageously allows objects below the shelf to be visible through it. In particular this improves user-friendliness.

It is further proposed that the holding element has an at least substantially rectangular cross section. An "at least substantially rectangular cross section" of an object here means in particular that for at least 80% of all the cross sections of the object along at least one direction, a surface content of a differential surface of the cross section and a smallest rectangle enclosing the cross section is maximum 20%, advantageously maximum 10% and particularly advantageously maximum 5% of the surface content of the rectangle. In particular the holding element is configured as a rectangular holding strip, advantageously as a holding strip produced by extrusion. In particular the holding element can be made at least substantially of a metal and/or plastic. The holding element is preferably configured as a hollow profile. This advantageously allows a holding element to be manufactured economically. It also advantageously allows easy cleaning.

The domestic appliance device here should not be limited to the application and embodiment described above. In particular the domestic appliance device can have a number of individual elements, components and units that is different from a number cited herein in order to implement a mode of operation described herein.

Further advantages will emerge from the description of the drawings which follows. The drawing shows exemplary embodiments of the invention. The drawing, description and claims contain numerous features in combination. The person skilled in the art will expediently also consider the features individually and combine them in useful further combinations.

DESCRIPTION OF THE INVENTION

Figure 1:
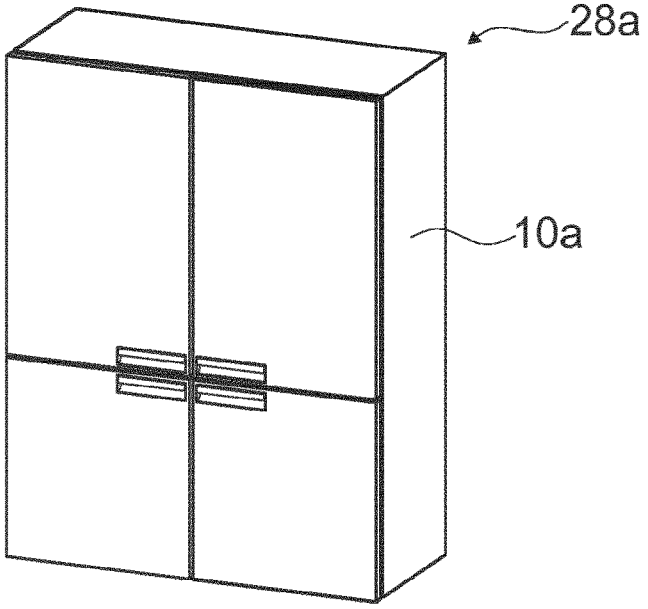
FIG. 1 shows a perspective view of a domestic refrigeration appliance with a domestic appliance device.

In the exemplary embodiments described in the following various structural units and/or components are present multiple times. For the purpose of simplification, similarly configured components and/or structural units shown with the same reference characters in the drawings are only described once in the description of the drawings that follows.

FIG. 1 shows a perspective view of a domestic appliance 28*a* configured as a refrigerator with a domestic appliance device with an appliance carcass 10*a*.

Figure 2:
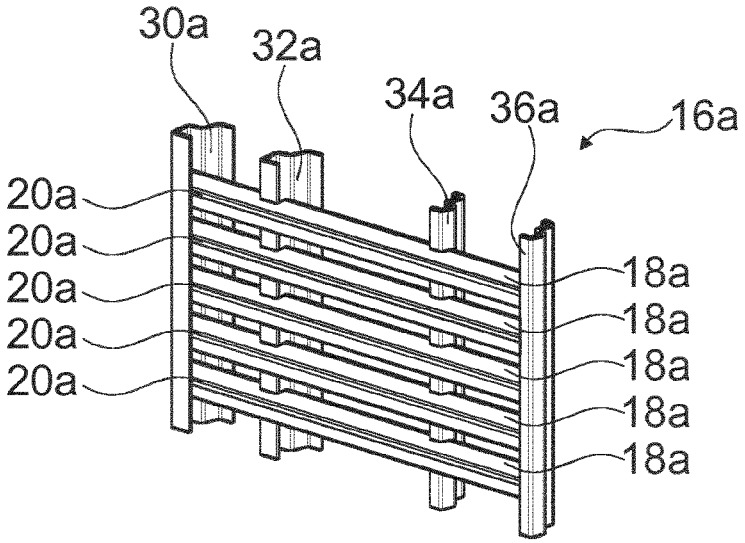
FIG. 2 shows a perspective view of a domestic refrigeration appliance with a domestic appliance device.

FIG. 2 shows a perspective view of a holding unit 16*a* of the domestic appliance device. The holding element 16*a* has a number of holding elements 18*a*, each with a holding recess 20*a*. The holding elements 18*a* are fastened to vertical rail elements 30*a*, 32*a*, 34*a*, 36*a*. The rail elements 30*a*, 32*a*, 34*a*, 36*a* are connected to the appliance carcass 10*a* (see also FIG. 5) and can dissipate any resulting holding forces. In the present instance the holding elements 18*a* are connected to the rail elements 30*a*, 32*a*, 34*a*, 36*a* by a latching connection. A main extension direction of the holding elements 18*a* runs in an at least substantially horizontal direction. A main extension direction of the holding recess 20*a* runs at least substantially parallel to the main extension direction of the corresponding holding element 18*a*. The length of the holding recess 20*a* here corresponds at least substantially to the length of the holding element 18*a*. The length of the holding element 18*a* extends over at least a majority of the width of an inner chamber 38*a* of the appliance carcass 10*a* (see FIG. 5). The holding elements 18*a* are aligned parallel to one another. The holding elements 18*a* are arranged one above the other. In the present instance the holding elements 18*a* are configured as continuously cast profiles made of steel.

Figure 3:
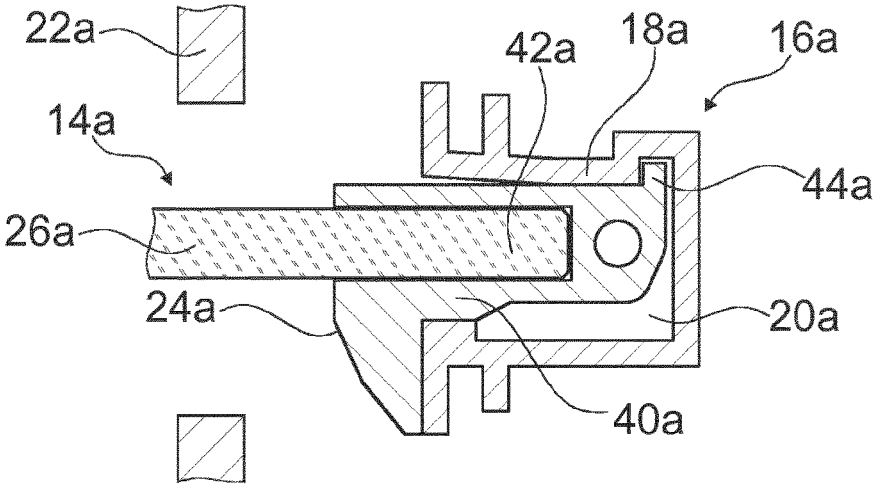
FIG. 3 shows a cross section of a unit for suspending a storage unit of the domestic appliance device from the holding unit of the domestic appliance device.

FIG. 3 shows a cross section of a unit for suspending a storage unit 14*a* of the domestic appliance device in one of the holding recesses 20*a* of one of the holding elements 18*a* of the holding unit 16*a* of the domestic appliance device. The holding element 18*a* has an at least substantially constant cross section along its main extension direction, which in FIG. 3 runs perpendicular to an image plane into the image plane. The storage unit 14*a* has a shelf 26*a*. In the present instance the shelf 26*a* is configured as a frameless safety glass plate. The storage unit 14*a* has a console profile 40*a* which holds the shelf 26*a* along a rear face 42*a* of the shelf 26*a*. The storage unit 14*a* has a hook profile 44*a*, which is provided for suspension in the holding recess 20*a*. The storage unit 14*a* has a bracing element 24*a* which counteracts a torque that results when the storage unit 14*a* is held. Forces that result when the storage unit 14*a* is held are induced into the holding element 18*a* of the holding unit 16*a* by the bracing element 24*a*. Assembly of the storage unit 14*a* is allowed by tilting the storage unit 14*a*, then introducing the hook profile 44*a* into the holding recess 20*a* of the holding element 18*a* and then tilting the storage unit 14*a* back into a position in which the hook profile 44*a* latches in the holding recess 20*a*. The storage unit 14*a* can be assembled on the holding unit 16*a* without tools. A facing element 22*a* is arranged in front of the holding element 18*a*.

Figure 4:
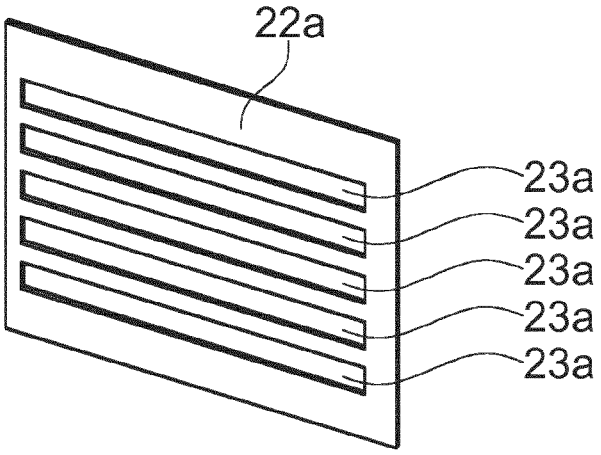
FIG. 4 shows a perspective view of a facing of the domestic appliance device.
Figure 5:
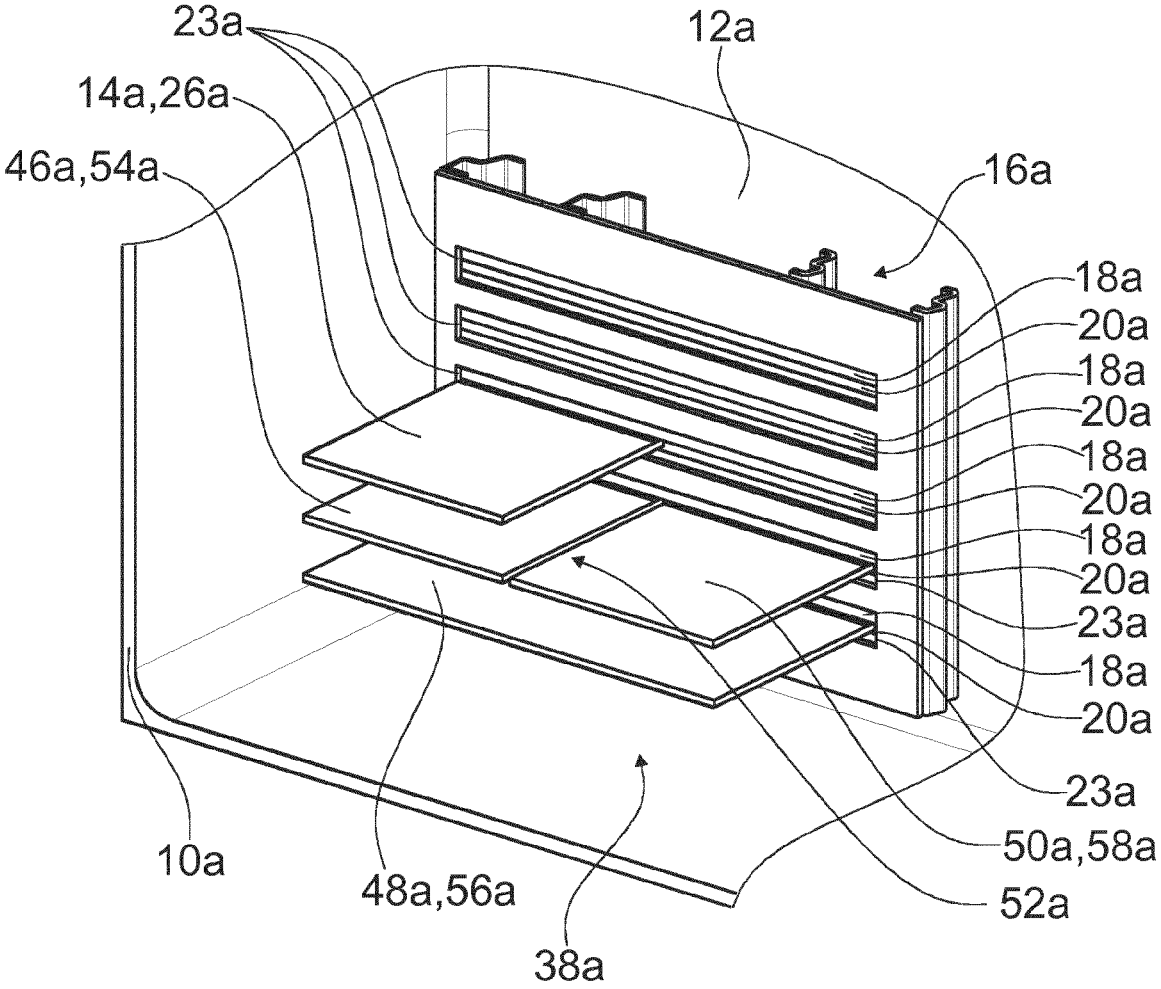
FIG. 5 shows a perspective view of the domestic appliance device.

FIG. 4 shows a perspective view of the facing element 22*a* of the domestic appliance device, arranged in an assembled state at least partially on a side of the holding unit 16*a* facing away from a rear wall 12*a* of the appliance carcass 10*a* (see FIG. 5). In the present instance the facing element 22*a* is made of plastic. It is however also possible for the facing element 22*a* to be made at least substantially of metal, for example stainless steel. Use of the facing element 22*a* is purely optional, in other words storage units 14*a* can also be assembled on the holding unit 16*a* without the facing element 22*a*. The facing element 22*a* has recesses 23*a*, each of which in at least one incorporated state at least partially exposes a holding element 18*a* arranged on a side of the facing element 22*a* facing the rear wall 12*a* in the direction of a side of the facing element 22*a* facing away from the rear wall 12*a* (see also FIG. 5).

FIG. 5 shows a perspective view of an inner chamber 38*a* of the appliance carcass 10*a* of the domestic appliance device. For the purposes of advantageous clarity only the described elements and units of the domestic appliance device are shown in FIG. 5 and other components, for example a right side wall, are omitted. The appliance carcass 10*a* comprises the rear wall 12*a*. In the present instance the holding unit 16*a* of the domestic appliance device is arranged on the rear wall 12*a*. In the present instance the holding unit 16*a* has five holding elements 18*a*. The holding elements 18*a* are arranged on a side of the facing element 22*a* of the domestic appliance device facing the rear wall 12*a*. The facing element 22*a* is arranged at least partially on a side of the holding unit 16*a* facing away from the rear wall 12*a*. In the present instance the facing element 22*a* is arranged in its entirety on a side of the holding unit 16*a* facing away from the rear wall 12*a*. The holding recesses 20*a* of the holding elements 18*a* are accessible from the inner chamber 38*a* through the recesses 23*a* of the facing element 22*a*. A main extension direction of the holding elements 18*a* runs in an at least substantially horizontal direction and at least substantially parallel to the rear wall 12*a*.

The domestic appliance device has storage units 14*a*, 46*a*, 48*a*, 50*a* with shelves 26*a*, 54*a*, 56*a*, 58*a*. The holding unit 16*a* is provided to support the storage unit 14*a* in such a manner that it can be displaced in at least one direction, which is aligned at least substantially parallel to the main extension direction of the holding element 18*a* holding the storage unit 14*a*. In the present instance a width of the shelf 26*a* of the storage unit 14*a* and a width of the console profile 40*a* of the storage unit 14*a* correspond to roughly half the length of the holding recess 20*a* of the holding element 18*a* holding the storage unit 14*a*. The storage unit 14*a* is supported in such a manner that it can be displaced along the holding recess 20*a*. Two storage units 46*a*, 50*a* with shelves 54*a*, 58*a* are also arranged next to one another in a shared holding recess 20*a* of a shared holding element 18*a*. The shelves 54*a*, 58*a* form a shared storage surface 52*a*. In the present instance the domestic appliance device also has a storage unit 48*a* with a shelf 56*a*, the width of which corresponds to the length of the holding recess 20*a* of the holding element 18*a* holding the shelf 56*a*.

Figure 6:
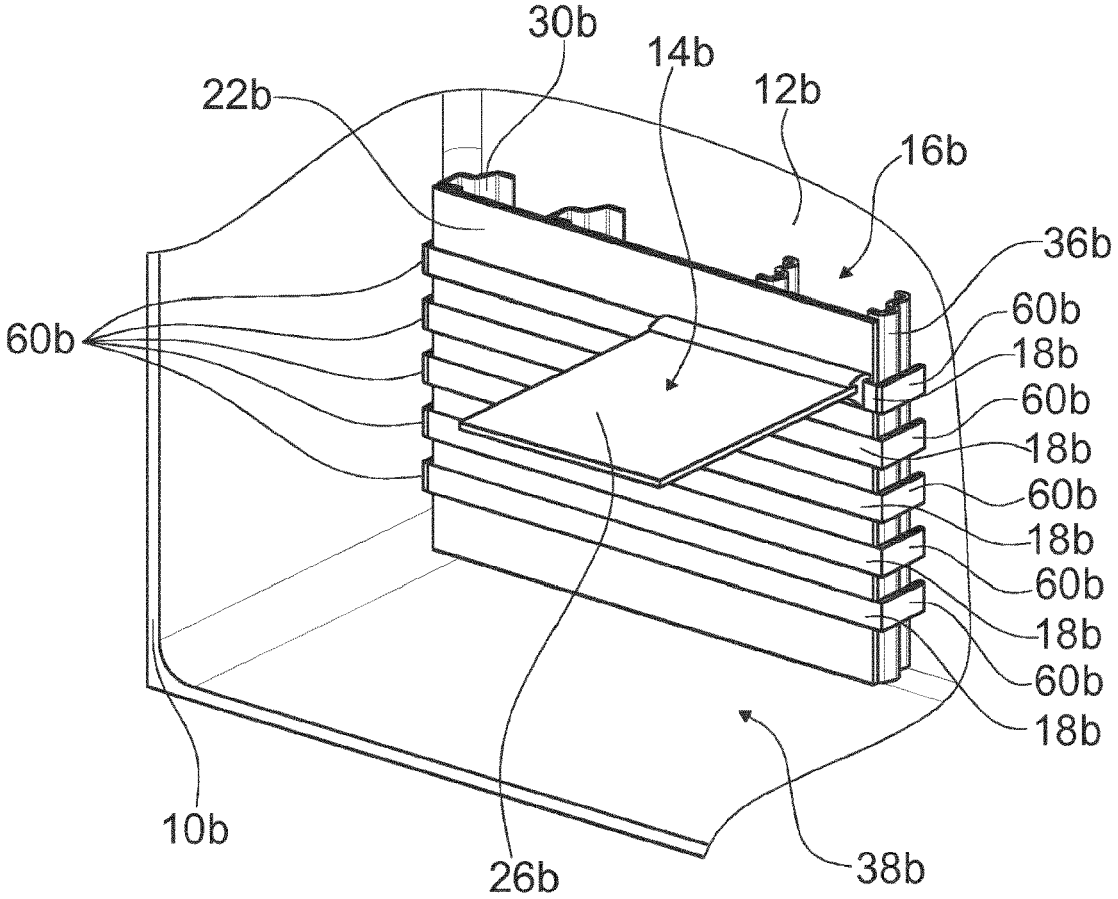
FIG. 6 shows a perspective view of further domestic appliance device and FIG. 7 shows a cross section of a unit for suspending a storage unit of the further domestic appliance device from FIG. 6 from a holding unit of the further domestic appliance device.
Figure 7:
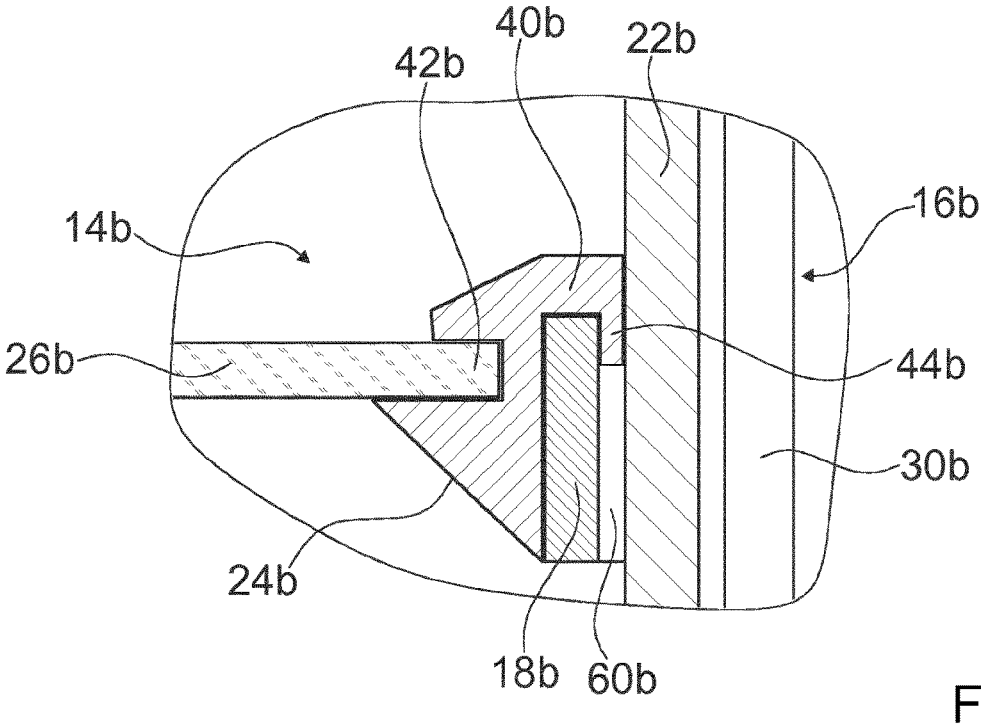

FIGS. 6 and 7 show a further exemplary embodiment of the invention. The following descriptions are limited substantially to the differences between the exemplary embodiments, it being possible to refer to the description of the exemplary embodiment in FIGS. 1 to 5 for identical components, features and functions. To distinguish between the exemplary embodiments the letter a in the reference characters of the exemplary embodiment in FIGS. 1 to 5 is replaced by the letter b in the reference characters of the exemplary embodiment in FIGS. 6 and 7. It is possible in principle also to refer to the drawings and/or the description of the exemplary embodiment in FIGS. 1 to 5 for identically referenced components, in particular for components with identical reference characters.

FIG. 6 shows a perspective view of an inner chamber 38*b* of an appliance carcass 10*b* of a further domestic appliance device. For the purposes of advantageous clarity only the described elements and units of the domestic appliance device are shown in FIG. 6 and other components, for example a right side wall, are omitted. The appliance carcass 10*b* has a rear wall 12*b*. Arranged on the rear wall 12*b* is a holding unit 16*b* of the further domestic appliance device. In the present instance the holding unit 16*b* has five holding elements 18*b*. The holding elements 18*b* have an at least substantially rectangular cross section. The holding elements 18*b* are each held by two fastening elements 60*b* of the holding unit 16*b* at one of its ends. The fastening elements 60*b* are each connected to a rail element 30*b*, 36*b* of the holding unit 16*b*. The further domestic appliance device has a facing element 22*b*. In the present instance the facing element 22*b* is configured as a plastic plate. It is however possible for the facing element 22*b* to be made at least substantially of metal, for example stainless steel. The holding elements 18*b* are arranged on a side of the facing element 22*b* of the further domestic appliance device facing away from the rear wall 12*b*. A main extension direction of the holding elements 18*b* runs in an at least substantially horizontal direction and at least substantially parallel to the rear wall 12*b*. The further domestic appliance device also has a storage unit 14*b* with a shelf 26*b*. The storage unit 14*b* is fastened to one of the holding elements 18*b* of the holding unit 16*b*. The holding unit 16*b* is provided to support the storage unit 14*b* in such a manner that it can be displaced in at least one direction, which is aligned at least substantially parallel to the main extension direction of the holding element 18*b* holding the storage unit 14*b*.

FIG. 7 shows a cross section of a unit for suspending the storage unit 14*b* of the further domestic appliance device from one of the holding units 16*b* of the further domestic appliance device. The holding element 18*b* of the holding unit 16*b* is connected to the rail element 30*b* of the holding unit 16*b* by way of a fastening element 60*b* of the holding unit 16*b*. The holding element 18*b* has an at least substantially constant rectangular cross section along its main extension direction, which in FIG. 7 runs perpendicular to an image plane into the image plane. The storage unit 14*b* comprises the shelf 26*b*. In the present instance the shelf 26*b* is configured as a frameless safety glass plate. The storage unit 14*b* has a console profile 40*b* which holds the shelf 26*b* along a rear face 42*b* of the shelf 26*b*. The storage unit 14*b* has a hook profile 44*b*, which engages at least partially around the holding element 18*b*. In an assembled state the console profile 40*b* is connected to the holding element 18*b* with a form fit. The storage unit 14*b* has a bracing element 24*b* which counteracts a torque that results when the storage unit 14*b* is held. Forces that result when the storage unit 14*b* is held are induced into the holding element 18*b* of the holding unit 16*b* by the bracing element 24*b*. Assembly of the storage unit 14*b* is allowed by raising the storage unit 14*b*, then passing the hook profile 44*b* over the holding element 18*b* and then positioning the storage unit 14*b* in such a manner that hook profile 44*b* engages partially around the holding element 18*b*. The storage unit 14*b* can be assembled on the holding unit 16*b* without tools. The facing element 22*b* is arranged behind the holding element 18*b*.

REFERENCE CHARACTERS

10 Appliance carcass
12 Rear wall
14 Storage unit
16 Holding unit
18 Holding element
20 Holding recess
22 Facing element
23 Recess
24 Bracing element
26 Shelf
28 Domestic appliance
30 Rail element
32 Rail element
34 Rail element
36 Rail element
38 Inner chamber
40 Console profile
42 Rear face
44 Hook profile
46 Storage unit
48 Storage unit
50 Storage unit
52 Storage surface
54 Shelf
56 Shelf
58 Shelf
60 Fastening element

The invention claimed is:

1. A domestic appliance device, comprising:

an appliance housing having a rear wall;

at least one storage unit;

a holding unit configured to hold said at least one storage unit, said holding unit having at least one holding element, said holding element having a main extension direction running at least substantially parallel to said rear wall and at least substantially in a horizontal direction in at least one operating state of the domestic appliance; and at least one facing element disposed on a side of said at least one holding unit facing away from said rear wall, at a free spacing distance from said holding element and spaced from said rear wall, and substantially parallel to said rear wall; and said facing element having at least one recess formed therein aligned with and exposing said at least one holding element.

2. The domestic appliance device according to claim 1, wherein said holding element is formed with a holding recess configured to receive at least part of said storage unit inserted therein.

3. The domestic appliance device according to claim 2, wherein a main extension direction of said holding recess runs at least substantially parallel to the main extension direction of said holding element.

4. The domestic appliance device according to claim 1, wherein said at least one holding element is one of a plurality of holding elements each extending substantially horizontally across said rear wall and vertically spaced from one another, and said at least one recess formed in said at least one facing element is one of a plurality of recesses extending horizontally across said facing element and being respectively aligned with said plurality of holding elements.

5. The domestic appliance device according to claim 4, wherein said holding element is arranged, at least in part, on a side of said facing element facing away from said rear wall.

6. The domestic appliance device according to claim 1, wherein said holding unit is configured to support said storage unit to enable said storage unit to be displaced in at least one direction, which is substantially parallel to the main extension direction of said holding element.

7. The domestic appliance device according to claim 1, wherein said storage unit comprises at least one bracing element configured to counteract a torque resulting from when said storage unit is mounted.

8. The domestic appliance device according to claim 1, wherein said storage unit is configured for toolless assembly on, and disassembly from said holding unit.

9. The domestic appliance device according to claim 1, wherein said storage unit comprises at least one shelf.

10. The domestic appliance device according to claim 9, wherein said shelf is at least partially transparent and frameless and/or at least partially translucent and frameless.

11. The domestic appliance device according to claim 1, wherein said holding element has a substantially rectangular cross section.

12. The domestic appliance device according to claim 1 configured for a domestic refrigeration appliance.

13. A domestic appliance, comprising at least one domestic appliance device according to claim 1.

14. The domestic appliance according to claim 13 configured as a domestic refrigeration appliance.

15. A domestic appliance device, comprising:

an appliance housing having a rear wall;

at least one storage unit;

a holding unit configured to hold said at least one storage unit, said holding unit having at least one holding element, said holding element having a main extension direction running along said rear wall, at least substantially parallel to said rear wall and at least substantially in a horizontal direction;

said at least one holding element being formed with a recess extending in the horizontal direction and being open in a direction away from said rear wall, and said recess having an undercut formed therein at an upper wall thereof; and said at least one storage unit having a bracing element formed for insertion into said recess of said holding element and being formed with support surfaces for engaging with said holding element and for counteracting a torque acting on said storage unit, said support surfaces of said bracing element including an upper support surface extending substantially horizontally and disposed to engage with said holding element and a lower support surface disposed to engage with said holding element at a position farther outward in the direction away from said rear wall than said upper support surface, and said bracing element having a hook profile extending vertically upward and being formed for insertion into said undercut.

16. The domestic appliance device according to claim 15, wherein said storage unit is a shelf, and wherein said recess in said holding element and said bracing element with said hook profile are configured such that said shelf is insertable into, and removable from, said holding element in an upwardly tilted orientation and said shelf is fixed in said holding element in the substantially horizontal orientation.

* * * * *